US006050325A

United States Patent [19]

Wheaton

[11] Patent Number: 6,050,325

[45] Date of Patent: Apr. 18, 2000

[54] METHOD OF CASTING A THIN WALL

[75] Inventor: Harold L. Wheaton, Bowerston, Ohio

[73] Assignee: PCC Airfoils, Inc., Cleveland, Ohio

[21] Appl. No.: 09/154,260

[22] Filed: Sep. 16, 1998

[51] Int. Cl.[7] ..... B22D 27/04; B22C 9/04

[52] U.S. Cl. ..... 164/516; 164/122.1; 164/35

[58] Field of Search ..... 164/122.1, 122.2, 164/516, 411, 34, 35

[56] References Cited

U.S. PATENT DOCUMENTS

| | | |
|---|---|---|
| 3,690,368 | 9/1972 | Copley et al. . |
| 3,848,654 | 11/1974 | Boyle et al. . |
| 4,043,379 | 8/1977 | Blazek . |
| 4,609,029 | 9/1986 | Vishnevsky et al. . |
| 4,617,977 | 10/1986 | Mills . |
| 4,724,891 | 2/1988 | Brookes . |
| 5,062,469 | 11/1991 | Monte et al. . |
| 5,295,530 | 3/1994 | O'Connor et al. . |
| 5,623,985 | 4/1997 | Wheaton et al. . |

*Primary Examiner*—Kuang Y. Lin
*Attorney, Agent, or Firm*—Tarolli, Sundheim, Covell, Tummino & Szabo L.L.P.

[57] ABSTRACT

An article has a thin wall portion with a thickness of 0.060 inches or less, a width of at least four inches, and a height of at least six inches. In order to cast the article, a pattern having a configuration corresponding to the configuration of the article is covered with a coating of wet ceramic material. In addition, a reinforcing pattern, which is spaced from the portion of the article pattern having a configuration corresponding to the thin wall portion of the article, is covered with the wet ceramic material. Space between the article pattern and reinforcing pattern is filled with the wet ceramic material. A combined mold structure and reinforcing structure are formed by drying the wet ceramic material. The article pattern is removed from the mold structure to leave a mold cavity. Molten metal is conducted into the mold cavity. Force is transmitted from the mold structure to the reinforcing structure to prevent deformation of the mold structure under the influence of force applied against the mold structure by the molten metal.

11 Claims, 3 Drawing Sheets

METHOD OF CASTING A THIN WALL

BACKGROUND OF THE INVENTION

The present invention relates to a method of casting a thin wall.

When a thin wall is to be cast, a mold having thin mold cavity is formed. When molten metal is poured into the mold cavity, the mold tends to bulge or creep under the influence of force applied against the mold by the molten metal.

The concept of preventing bulging or creeping of mold walls during the casting of a thin wall by using one or more pins is disclosed in U.S. Pat. No. 5,623,985. A first end portion of each of the pins is disposed in a first wall of the mold structure. A second end portion of each of the pins is disposed in a second wall of the mold structure. The end portions of the pins and the walls of the mold structure are interlocked to prevent relative movement between the walls of the mold structure.

SUMMARY OF THE INVENTION

The present invention provides a new and improved method for use in casting an article having a thin wall portion. The method includes providing an article pattern having at least a portion with a configuration corresponding to the configuration of the thin wall portion of the article. A reinforcing pattern may be spaced from the portion of the article pattern having a configuration corresponding to the configuration of the thin wall portion of the article. The article pattern and the reinforcing pattern are covered with a coating of wet ceramic material. The coating of wet ceramic material fills the space between the article pattern and the reinforcing pattern.

After the wet ceramic material has dried, the article pattern is removed to leave a mold cavity. Molten metal is poured in to the mold cavity. Force is transmitted to the ceramic material which dried around the reinforcing pattern to prevent deformation of the mold by the metal.

It is preferred to utilize a reinforcing pattern in association with the article pattern to facilitate the formation of a reinforcing structure formed of ceramic material. However, the reinforcing pattern may be omitted and the wet ceramic material shaped to form a reinforcing structure without the use of the reinforcing pattern.

Although the method of the present invention may be utilized to cast many different types of objects, it is believed that the method will be particularly advantageous in casting relatively long, and/or wide metal objects which are very thin. Thus, the method may be used to cast a metal object having a thin wall portion with a thickness of 0.060 inches or less, a width of at least four inches, and a height of at least six inches. Although the thin wall portion of the cast article could be formed of many different metals having any one of many different crystallographic structures, the method and apparatus may advantageously be used to form a single crystal metal article, such as a plate or airfoil. The method may also advantageously be used to form an article having a columnar grained or equiaxed crystallographic structure.

BRIEF DESCRIPTION OF THE DRAWINGS

The foregoing and other features of the invention will become more apparent upon a consideration of the following description taken in connection with the accompanying drawings wherein.

DESCRIPTION OF ONE SPECIFIC PREFERRED EMBODIMENT OF THE INVENTION

Figure 1:
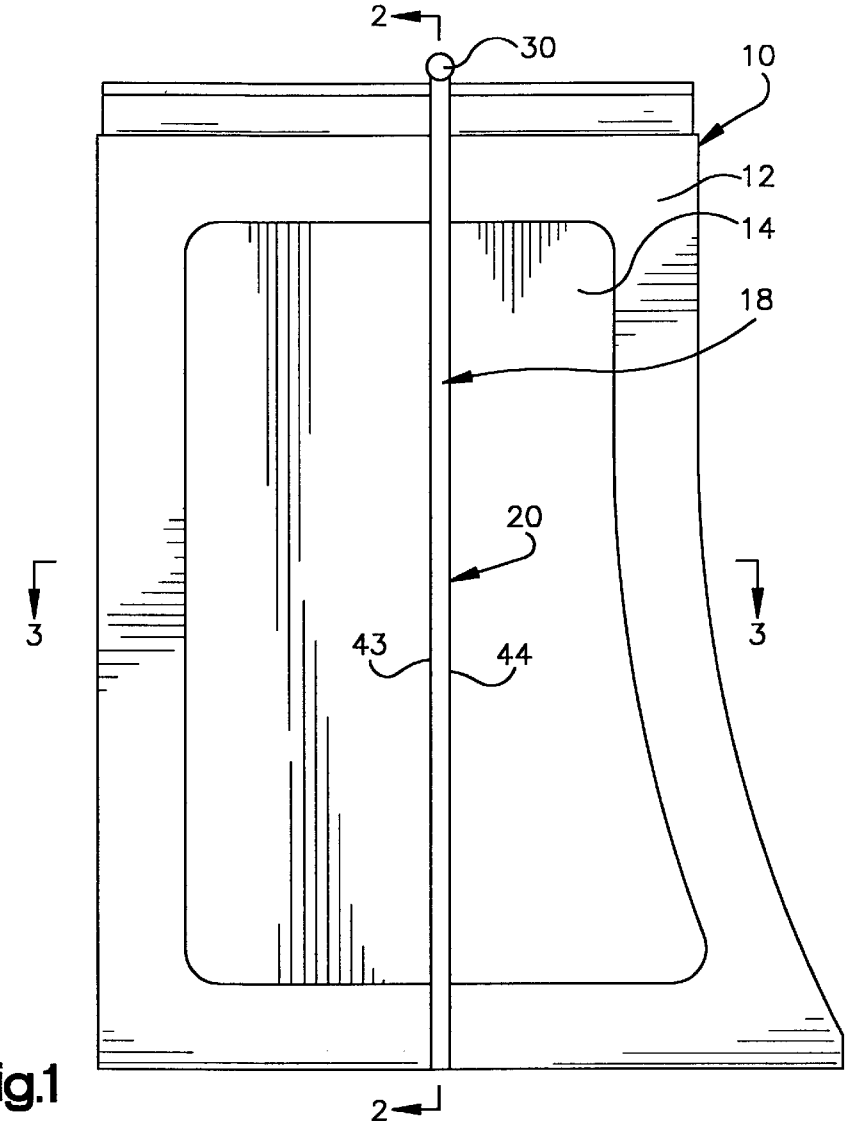
FIG. 1 is a simplified schematic illustration of an article pattern for a thin walled metal article and a reinforcing pattern which is used in association with the article pattern.

A metal article having a thin wall portion with a thickness of 0.060 inches or less, a width of at least four inches, and a height of at least six inches has a configuration which is the same as the configuration of a wax article pattern 10 illustrated in FIG. 1. The article pattern 10 includes a relatively thick frame portion 12 which extends around a thin wall portion 14. The thin wall portion 14 of the article pattern 10 has a thickness of 0.060 inches or less, a width, which is measured horizontally as viewed in FIG. 1, of at least four inches, and a height, which is measured vertically as viewed in FIG. 1, of at least six inches.

Although an article pattern 10 corresponding to one specific cast metal article has been illustrated in FIG. 1, it should be understood that the article pattern 10 could have a configuration corresponding to the configuration of many different cast metal articles. For example, the article pattern 10 could have a configuration corresponding to the configuration of a thin metal airfoil. Alternatively, the article pattern 10 could have a configuration corresponding to the configuration of a portion of a turbine engine housing. Although the article pattern 10 has a frame portion 12, it is contemplated that the entire article pattern could be formed by the thin wall portion 14 if desired.

Figure 2:
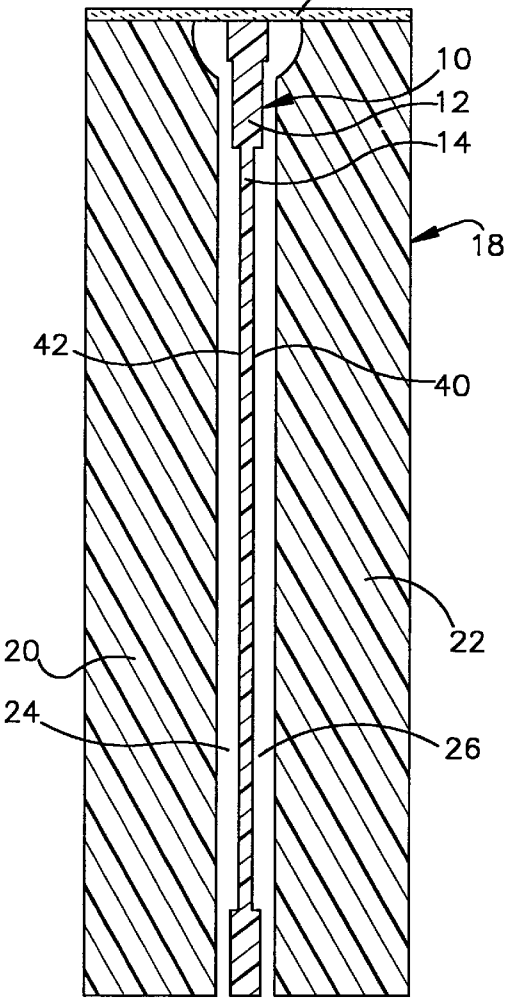
FIG. 2 is a sectional view, taken generally along the line 2—2 of FIG. 1, further illustrating the relationship between the article pattern and reinforcing pattern.
Figure 3:
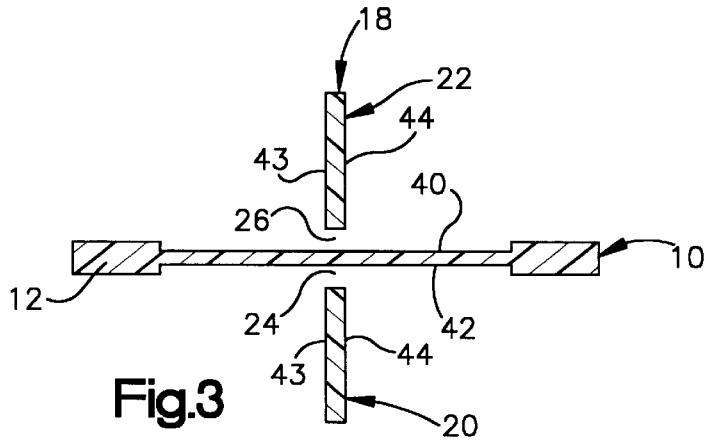
FIG. 3 is a plan view, taken generally along the line 3—3 of FIG. 1, further illustrating the relationship between the article pattern and the reinforcing pattern.

In accordance with a feature of the present invention, a reinforcing pattern 18 is provided in association with the article pattern 10. The wax reinforcing pattern 18 includes a left (as viewed in FIG. 2) section 20 and a right section 22. The illustrated left and right sections 20 and 22 of the reinforcing pattern 18 have a rectangular configuration. The left and right sections 20 and 22 of the reinforcing pattern 18 are separated from the article pattern 10 by a pair of slots or spaces 24 and 26 (FIGS. 2 and 3). However, the spaces 24 and 26 could be omitted if desired.

The left and right sections 20 and 22 of the reinforcing pattern 18 are spaced apart from the thin wall portion 14 of the article pattern 10 by a uniform distance throughout the extent of the thin wall portion of the article pattern. In the illustrated embodiment of the invention, the upper (as viewed in FIG. 2) end portion of the left and right sections 20 and 22 of the reinforcing pattern 18 are connected with a portion of a gating pattern, disposed above the article pattern 10, by an alumina rod 30. The left and right sections 20 and 22 of the reinforcing pattern 18 could be integrally formed as one piece with the article pattern 10.

The left and right sections 20 and 22 of the reinforcing pattern 18 could be connected directly with the frame portion 12. However, if the left and right sections 20 and 22 of reinforcing pattern 18 are connected directly to the article pattern 10, this would result in excess metal being connected with the cast article. The excess metal would have to be removed. Therefore, it is believed that it will be preferred to provide the spaces 24 and 26 between the left and right sections 20 and 22 of the reinforcing pattern 18 and the article pattern 10.

Although only a single article pattern 10 and a single reinforcing pattern 18 are illustrated in FIGS. 1–3, it is contemplated that a plurality of the article patterns and associated reinforcing patterns will be connected in a circular array. The lower ends of the article patterns 10 and the reinforcing patterns 18 in the circular array may be supported on a circular ceramic base plate. Of course, if desired, only a single article pattern and single reinforcing pattern may be used. The article pattern 10 and reinforcing pattern 18 may have almost any desired configuration.

Regardless of the number of article patterns and reinforcing patterns that are used, a wax pattern for suitable gating is connected with the article pattern 10. It is believed that it may be desired to use a single gating pattern in association with a plurality of the article patterns. If desired, the wax gating pattern could be provided with a main pour cup section, a main metal flow section, and a plurality of secondary passage sections. The secondary passage sections of the gating pattern may be connected with the frame portion 12 of the article pattern 10. The gating pattern is also connected with the reinforcing pattern 18.

Once the article pattern 10, the reinforcing pattern 18 and the gating pattern have been interconnected, the entire wax pattern assembly is covered with a coating of wet ceramic material. In addition to covering the article pattern 10 and reinforcing pattern 18, the wet ceramic material covers the gating pattern.

Figure 4:
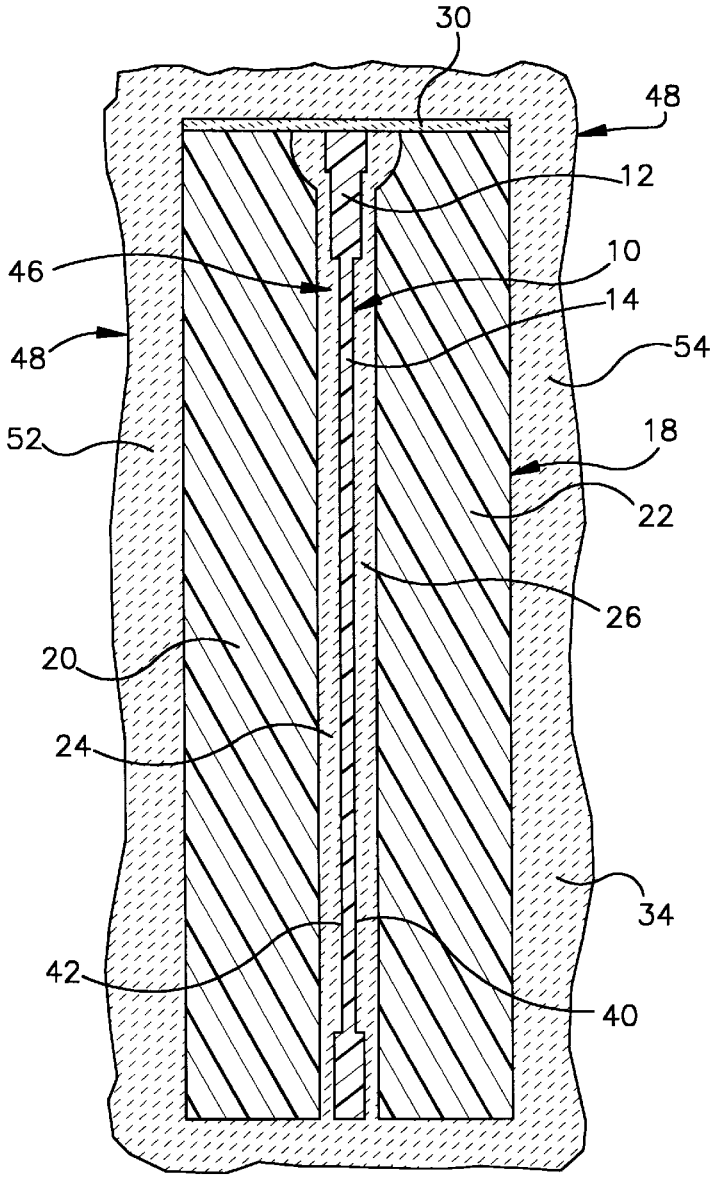
FIG. 4 is a sectional view, generally similar to FIG. 2, illustrating the manner in which the article pattern and the reinforcing pattern are covered with wet ceramic material.
Figure 5:
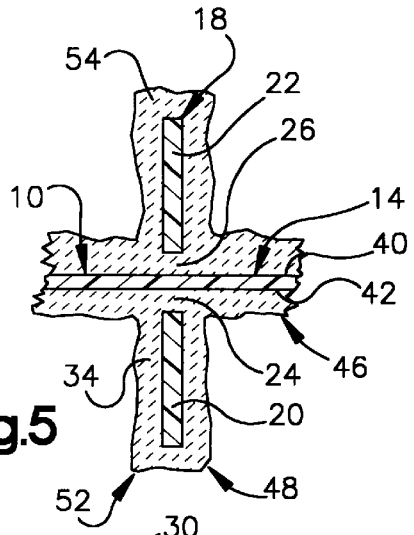
FIG. 5 is a fragmentary plan view, generally similar to a portion of FIG. 3, illustrating the manner in which the wet ceramic material fills spaces between the article pattern and the reinforcing pattern.

The manner in which the article pattern 10 and reinforcing pattern 18 are covered with a wet coating of ceramic material is illustrated schematically in FIGS. 4 and 5. Thus, a wet coating 34 of ceramic material completely encloses the article pattern 10 and the reinforcing pattern 18 with the exception of locations (not shown) where the gating pattern is connected with the article pattern and reinforcing pattern. The gating pattern (not shown) is, itself, enclosed by the wet coating of ceramic material. If the article is to be cast as a single crystal, a wax pattern of a single crystal selector may be connected with the article pattern 10 and covered by the wet coating 34 of ceramic material.

To apply the wet coating 34 of ceramic material to the article pattern 10, reinforcing pattern 18 and the gating pattern (not shown) and, if desired, a crystal selector pattern, the entire pattern assembly is repeatedly dipped in a slurry of liquid ceramic mold material and stuccoed. Although many different types of slurries of ceramic mold material could be utilized, one illustrative slurry contains fused silica, zircon and other refractory materials in combination with binders. Chemical binders such as ethyl silicate, sodium silicate and colloidal silica can be utilized. In addition, the slurry may contain suitable film formers such alginates, to control viscosity and wetting agents to control flow characteristics and pattern wettability.

Alternatively, the ceramic slurry which forms the mold material could have the composition disclosed in U.S. Pat. No. 4,947,927 issued Aug. 14, 1990 and entitled "Method of Casting A Reactive Metal Against a Surface Formed From an Improved Slurry Containing Yttria." It is believed that the ceramic slurry disclosed in the aforementioned U.S. Pat. No. 4,947,927 may be particularly advantageous when the article to be cast is formed of a reactive metal, such as titanium or a nickel-chrome super alloy. Of course, other known ceramic materials could be utilized if desired.

The wax pattern assembly which includes the article pattern 10 and reinforcing pattern 18 is repetitively dipped in the ceramic slurry and stuccoed with refractory grain until a coating 34 of a desired thickness is formed. The wet coating 34 of ceramic material extends into and completely fills the slot or space 24 between the thin wall portion 14 of the article pattern 10 and the left section 20 of the reinforcing pattern 18. Similarly, the wet coating 34 of ceramic material completely fills the slot or space 26 between the thin wall portion 14 and the right section 22 of the reinforcing pattern 18 (FIG. 4). In the specific article pattern 10 illustrated in the drawings, the thin wall portion 14 of the article pattern has a pair of flat parallel major side surfaces 40 and 42 (FIGS. 3 and 5). The wet coating 34 of ceramic material (FIG. 5) completely covers the parallel side surfaces 40 and 42 of the article pattern 10.

The identical rectangular sections 20 and 22 of the reinforcing pattern have parallel major side surfaces 43 and 44 (FIGS. 1 and 3). The major side surfaces 43 and 44 of the rectangular reinforcing pattern sections 20 and 22 are interconnected by minor side surfaces. The major side surfaces 43 and 44 of the reinforcing pattern sections 20 and 22 extend perpendicular to the major side surfaces 40 and 42 of the article pattern 10.

The identical major side surfaces 43 on the left and right sections 20 and 22 are disposed in a single plane which extends perpendicular to the major side surfaces 40 and 42 of the article pattern 10. Similarly, the identical major side surfaces 44 on the left and right sections 20 and 22 are disposed in a single plane which extends perpendicular to the major side surfaces 40 and 42 of the article pattern 10. Longitudinally extending linear edge portions of the left and right sections 20 and 22 of the reinforcing pattern 18 extend parallel to the major side surfaces 40 and 42 of the article pattern 10.

It should be understood that the left and right sections 20 and 22 of the reinforcing pattern 18 could have a different configuration if desired. For example, the left and right sections 20 and 22 could have a cylindrical configuration. Alternatively, the left section 20 could have a square configuration and the right section 22 could have a cylindrical configuration.

The wet coating 34 of ceramic material is dried to form a mold structure 46 and a reinforcing structure 48 (FIG. 5). The mold structure 46 and reinforcing structure 48 are integrally formed as one piece of ceramic mold material which encloses the article pattern 10 and the left and right sections 20 and 22 of the reinforcing pattern 18.

The reinforcing structure 48 includes a pair of identical elongated reinforcing elements 52 and 54 which extend along opposite sides of the thin wall portion 14 of the article pattern 10. The reinforcing element 52 is formed by enclosing the left section 20 of the reinforcing pattern 18 with the coating 34 of ceramic material. The reinforcing element 54 is formed by enclosing the right section 22 of the reinforcing pattern 18 with the coating 34 of ceramic material. Since the two reinforcing elements 52 and 54 were formed by solidifying the continuous wet coating 34 of ceramic material, the two reinforcing elements 52 and 54 are integrally formed as one piece with each other and with the mold structure 48 which encloses the article pattern 10.

At the same time that the wet coating 34 of ceramic material over the article pattern 10 and reinforcing pattern 18 is dried, the wet coating of ceramic material over the gating pattern and, if used, single crystal selector pattern, is dried. This results in the gating, single crystal selector, mold structure 46, and reinforcing structure 48 all being integrally formed as one piece of ceramic material.

Although it is preferred to use the reinforcing pattern 18 to form the reinforcing elements 52 and 54, the reinforcing elements could be formed in a different manner if desired. For example, the reinforcing elements could be molded separately from the mold structure 46 and subsequently connected with mold structure. Alternatively, the reinforcing elements could be molded along with the mold structure 46 by enclosing only the article pattern 10 in a mold and molding a body of wet ceramic material to form the mold structure 46 and reinforcing elements 52 and 54 without using a reinforcing pattern 18.

Once the wet coating 34 of ceramic material has been dried in the manner previously explained, the article pattern 10 and reinforcing pattern 18 are removed. The article pattern 10 and the reinforcing pattern 18 may be formed of a natural or synthetic wax and removed by melting the wax. The melted wax is removed from the mold structure 46 and reinforcing structure 48 through openings formed in the gating connected with the mold structure and reinforcing structure. If desired, the article pattern 10 and reinforcing pattern 18 could be formed of materials other than wax and removed in a manner other than by melting the material.

Figure 7:
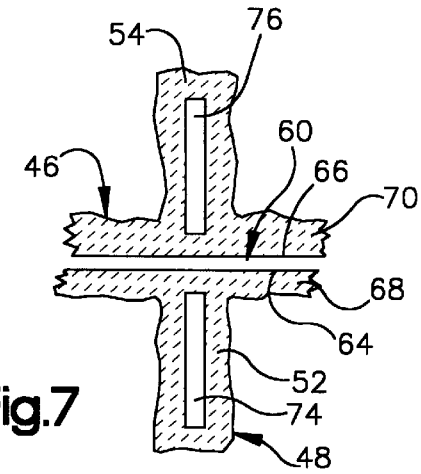
FIG. 7 is a fragmentary plan view, generally similar to FIG. 5, further illustrating the relationship between the article mold cavity and the reinforcing pattern cavity.
Figure 6:
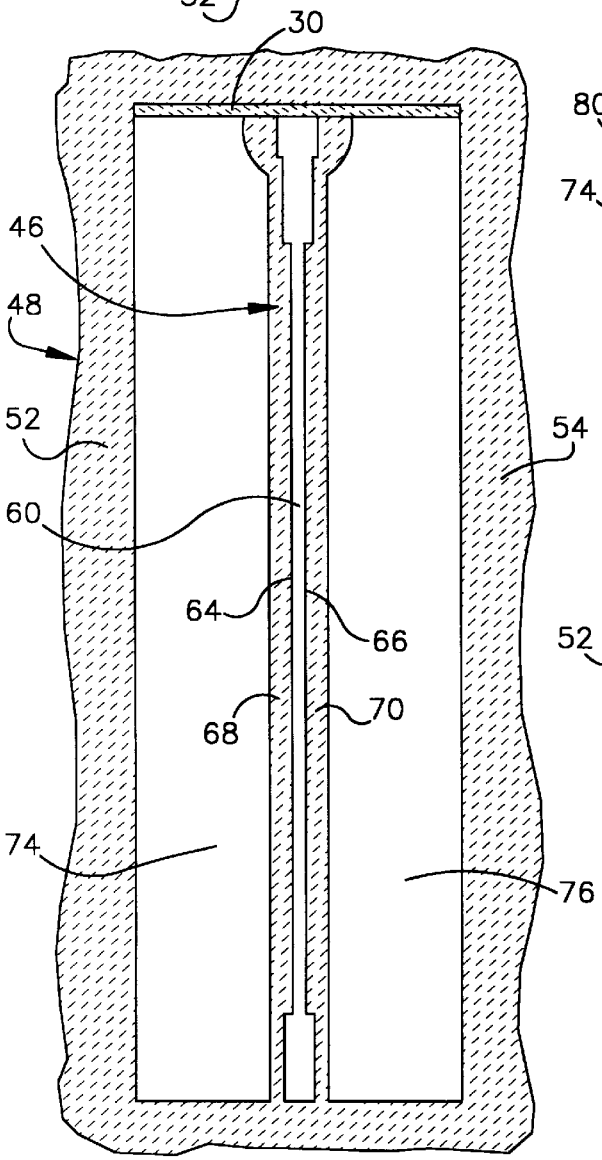
FIG. 6 is a sectional view, generally similar to FIGS. 2 and 4, illustrating an article mold cavity and a reinforcing pattern cavity which were formed by drying the wet ceramic material and removing the article pattern and reinforcing pattern.

Removal of the article pattern 10 from the mold structure 46 leaves an article mold cavity 60 (FIGS. 6 and 7). The article mold cavity 60 has the same configuration as the article pattern 10. Thus, a portion of the article mold cavity 60 has a configuration corresponding to the thin wall portion 14 of the article pattern 10. Other portions of the article mold cavity 60 have the same configurations the frame portion 12 of the article pattern 10. After the wax patterns have been removed, the entire mold is fired, in a known manner, to harden the ceramic material.

The resulting article mold cavity 60 (FIG. 7) has a pair of continuous flat parallel side surfaces 64 and 66 which are disposed on opposite side walls 68 and 70 of the mold structure 46. The parallel side surfaces 64 and 66 are used to shape molten metal which forms the thin wall portion of the cast article. Therefore, the side surfaces 64 and 66 are spaced apart by a distance of 0.060 inches or less. The side surfaces 64 and 66 have a height (FIG. 6) of at least six inches. The side surfaces 64 and 66 have a width (FIG. 7) of at least four inches.

In the illustrated embodiment of the invention, the metal article which is to be cast in the mold structure 46 has a thin wall portion with flat parallel side surfaces. However, it should be understood that the thin wall portion of the cast article could have a different configuration. For example, the thin wall portion of the cast article could have an arcuate configuration.

If the thin wall portion of the cast article has an arcuate configuration, the side surfaces 64 and 66 of the article mold cavity 60 would also have an arcuate configuration. For example, the side surfaces 64 and 66 of the article mold cavity 60 could be formed as portions of circles having a common center of curvature. One of the side surfaces, for example the side surface 64, would be spaced a first distance from the center of curvature while the other side surface, for example, the side surface 66, would have a radius which differs from the radius of the side surface 64 by 0.060 inches or less.

The article mold cavity 60 has a configuration corresponding to the configuration of an article represented by the article pattern 10 of FIG. 1. However, the article mold cavity 60 could have a configuration corresponding to a configuration of an article having a substantially different structure than the article represented by the pattern 10. For example, the article mold 60 could have a configuration corresponding to the configuration of a portion of a turbine engine component, similar to the turbine engine component illustrated in U.S. Pat. No. 4,724,891 issued Feb. 16, 1988 and entitled "Thin Wall Casting". Alternatively, the article mold cavity 60 could have a configuration corresponding to the configuration of an airfoil used in a turbine engine. This airfoil could have convex and concave surfaces and/or have an axial twist in accordance with known airfoil configurations.

Removal of the reinforcing pattern 18 from the reinforcing structure 48 leaves a pair of identical reinforcing pattern cavities 74 and 76. The reinforcing pattern cavities 74 and 76 are disposed in the reinforcing structure 48 on opposite sides of the mold cavity 60 (FIGS. 6 and 7). The reinforcing pattern cavity 74 is formed by the removal of the left section 20 (FIG. 5) of the reinforcing pattern 18. The reinforcing pattern cavity 74 has a longitudinal central or vertical axis which extends parallel to the side surface 64 of the article mold cavity 60. The reinforcing pattern cavity 74 has a vertical extent which is the same as the vertical extent of the article mold cavity 60.

The reinforcing pattern cavity 76 (FIGS. 6 and 7) has a longitudinal central or vertical axis which is parallel to the side surface 66 of the article mold cavity 60. The reinforcing pattern cavity 76 has a vertical extent which is the same as the vertical extent of the article mold cavity 60 and the reinforcing pattern cavity 74. The reinforcing element 54 has a vertical extent which is the same as the vertical extent of the mold structure 46 and the vertical extent of the reinforcing element 52.

Figure 8:
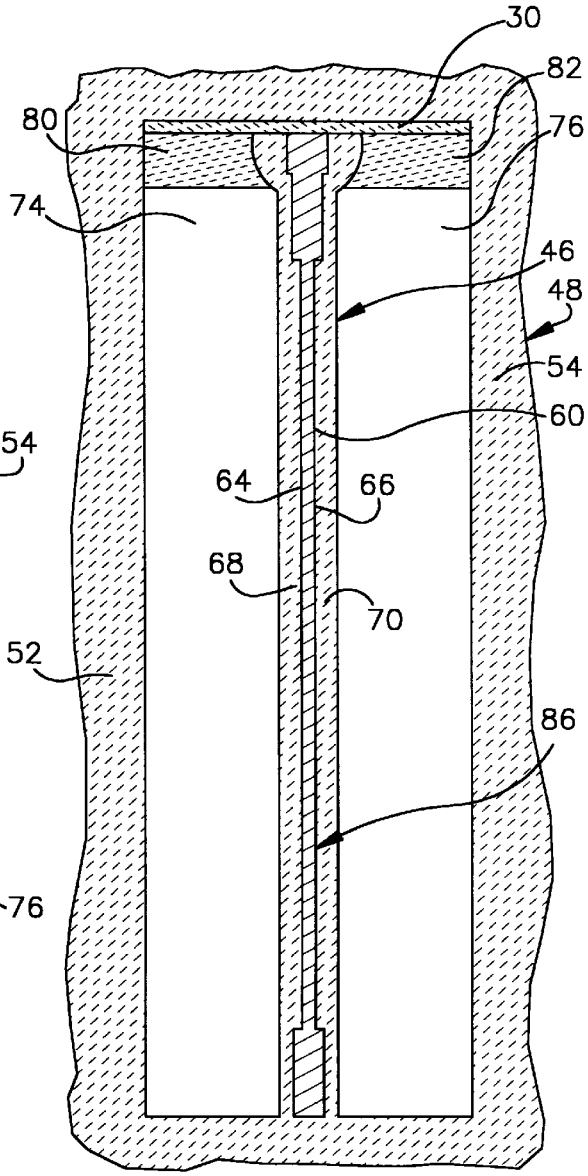
FIG. 8 is a sectional view, generally similar to FIG. 6, illustrating the manner in which the article mold cavity is filled with molten metal which is solidified to form the metal article having a thin wall portion.

Once the article pattern 10 and reinforcing pattern 18 have been removed from the mold and the mold fired, the openings through which the sections 20 and 22 (FIG. 5) of the reinforcing pattern 18 were removed from the reinforcing structure 48 are blocked in the manner indicated schematically at 80 and 82 in FIG. 8. Blocking the upper ends of the openings to the reinforcing pattern cavities 74 and 76 prevents molten metal from flowing from the gating system into the reinforcing pattern cavities 74 and 76.

Once the reinforcing pattern cavities 74 and 76 have been sealed, molten metal is poured into the gating system for the mold structure 46. The molten metal flows from the gating system for the mold structure into the article mold cavity 60. As the article mold cavity 60 fills with molten metal, in the manner illustrated schematically in FIG. 8, substantial pressure force is applied against the opposite side walls 68 and 70 of the mold structure 46 by the molten metal.

This molten metal pressure force tends to cause high temperature deformation of the ceramic material forming the mold structure 46. However, the molten metal pressure force is transmitted from the side walls 68 and 70 of the mold structure 46 to the reinforcing elements 52 and 54 of the reinforcing structure 48. The reinforcing elements 52 and 54 support the side walls 68 and 70 of the mold structure 46 to prevent deformation of the side walls of the mold structure by the pressure force.

When the article mold cavity 60 is filled with molten metal, the metal applies force against the opposite inner side surfaces 64 and 66 of the article mold cavity. This force is transmitted from the side walls 68 and 70 of the mold structure 46 to the elements 52 and 54 of the reinforcing structure 48. The parallel reinforcing elements 52 and 54 extend between vertically opposite ends of the mold structure 46 (FIG. 8). Therefore, force can be transmitted from the side walls 68 and 70 of the mold structure 46 to the reinforcing structure 48 throughout the entire vertical extent of the mold structure.

The molten metal is solidified in the article mold cavity 60 to form the metal article 82. The mold structure 46 and reinforcing structure 48 are destroyed to release the cast article 82. Although the cast article 86 may be formed of many different types of metal, such as titanium or aluminum, it is contemplated that it may be preferred to form the cast article from a nickel-chrome super alloy.

The cast article 86 may be formed with any desired crystallographic structure. The cast article 86 may have an equiaxed or columnar grain crystallographic structure. If the cast article is formed as a single crystal, it is contemplated that a single crystal selector may be connected with the mold structure 46 in the manner indicated schematically in U.S. Pat. No. 5,623,985 issued Apr. 29, 1997 and entitled "Apparatus and Method For Molding An Article". It is believed that it may be preferred to form the article 86 with an equiaxed crystallographic structure.

In the illustrated embodiment of the invention, a single reinforcing pattern 18 (FIG. 1) was used in association with the article pattern 10. However, it is contemplated that a plurality of reinforcing patterns 18 could be used with an article pattern if desired. Thus, if the thin wall portion 14 of the article pattern 10 has a large horizontal extent, two or more reinforcing patterns 18 could be associated with the article pattern. Of course, using a plurality of reinforcing patterns 18 in association with an article pattern 10 will result in the formation of a plurality of reinforcing structures 48 (FIG. 5) in association with the mold structure 46. It is believed that the use of a plurality of reinforcing structures 48 in association with the mold structure 46 will be particularly advantageous when the article to be cast has a substantial width, that is, when the article pattern 10 has a substantial horizontal extent as viewed in FIG. 1.

It should be understood that the article pattern 10 and the reinforcing pattern 18 could have a size and configuration which is substantially different than the size and configuration illustrated in FIGS. 1–3. However, in the specific embodiment of the article pattern illustrated in FIGS. 1–3, the thin wall portion 14 of the article pattern 10 has a height, that is vertical extent, of approximately nine inches. The thin wall portion 14 of the article pattern 10 had a width, that is a horizontal extent, of approximately seven inches. The thin wall portion 14 had a thickness of approximately 0.04 inches.

For this specific article pattern, only a single reinforcing pattern 18 is required. The left and right sections 20 and 22 of the reinforcing pattern 18 had a vertical extent, that is height, corresponding to the vertical extent of the article pattern 10. The left and right sections 20 and 22 of the reinforcing pattern 18 had a width, that is a horizontal extent as viewed in FIG. 2, of approximately one inch and a thickness in the 0.1 to 0.2 inch range. These specific left and right pattern sections 20 and 22 (FIG. 2) were spaced from the thin wall section 14 of the article pattern 10 by a uniform distance of approximately 0.25 to 0.38 inches.

If the spaces 24 and 26 are too small, the side walls 68 and 70 (FIG. 6) of the mold structure 46 will be too thin and crack. This may result in molten metal flowing into the reinforcing pattern cavities 74 and 76. If the spaces 24 and 26 are too large, an inordinate number of dips in the ceramic slurry would be required to fill the spaces 24 and 26. It is presently (preferred to position the left and right reinforcing sections 20 and 22 (FIG. 2) with uniform spaces or slots 24 and 26 having a thickness of approximately 0.2 inches to 0.5 inches. The left and right reinforcing sections 20 and 22 have edge portions which are parallel to the major sides 40 and 42 of the article pattern 10 (FIG. 4).

The reinforcing elements 52 and 54 should have sufficient width, as measured in a direction perpendicular to the major side surfaces 40 and 42 (FIG. 5) of the article pattern 10, to provide the structural length required to prevent deformation of the side walls 68 and 70 (FIG. 7) of the mold structure 46. However, as a practical matter, there is a limit to the width of the reinforcing elements 52 and 54. It is presently preferred to form the left and right sections 20 and 22 of the reinforcing pattern 18 (FIG. 5) with a width, as measured in a direction perpendicular to the major side surfaces 40 and 42 of the article pattern 10, of between 0.5 inches and 2.5 inches.

It should be understood that the foregoing specific dimensions for the article pattern 10 and reinforcing pattern 18 and their spatial relationships to each other have been set forth herein for purposes of clarity of description. It is contemplated that the article pattern 10 and reinforcing pattern 18 could be constructed with many different configurations and dimensions. It is also contemplated that the article pattern 10 and reinforcing pattern 18 could be placed in many different spatial relationships relative to each other.

In the illustrated embodiment of the article pattern 10 and the reinforcing pattern 18, the reinforcing pattern is formed of the same natural or synthetic wax as the article pattern. However, it is contemplated that the reinforcing pattern 18 may be formed of a material which is different than the material forming the article pattern 10. For example, the reinforcing pattern 18 could be formed of a ceramic material. If this was done, the reinforcing pattern would not be removed from the reinforcing structure 48 when the article pattern 10 is removed from the mold structure 46. The ceramic material of the reinforcing pattern 18 would strengthen the reinforcing elements 52 and 54. It should be understood that the reinforcing pattern 18 could have left and right sections 20 and 22 with configurations which are different than the illustrated rectangular configuration.

In view of the foregoing description, it is apparent that the present invention provides a new and improved method for use in casting an article 86 having a thin wall portion. The method includes providing an article pattern 10 having a portion 14 with a configuration corresponding to the configuration of the thin wall portion of the article 86. A reinforcing pattern 18 may be spaced from the portion 14 of the article pattern 10 having a configuration corresponding to the configuration of the thin wall portion of the article. The article pattern 10 and the reinforcing pattern 18 are covered with a coating 34 of wet ceramic material. The coating 34 of wet ceramic material fills the space 24 and 26 between the article pattern 10 and the reinforcing pattern 18.

After the wet ceramic material 34 has dried, the article pattern 10 is removed to leave a mold cavity 60. Molten metal is poured in to the mold cavity 60. Force is transmitted to the ceramic material 34 which dried around the reinforcing pattern 18 to prevent deformation of the mold 46 by the metal.

It is preferred to utilize a reinforcing pattern 18 in association with the article pattern 10 to facilitate the formation of a reinforcing structure 48 formed of ceramic material. However, the reinforcing pattern 18 may be omitted and the wet ceramic material 34 shaped to form a reinforcing structure 48 without the use of the reinforcing pattern.

Although the method of the present invention may be utilized to cast many different types of objects, it is believed that the method will be particularly advantageous in casting relatively long, and/or wide metal objects which are very thin. Thus, the method may be used to cast a metal object 86 having a thin wall portion with a thickness of 0.060 inches or less, a width of at least four inches, and a height of at least six inches. Although the thin wall portion of the cast article 86 could be formed of many different metals having any one of many different crystallographic structures, the method and apparatus may advantageously be used to form a single crystal metal article, such as a plate or airfoil. The method may also advantageously be used to form an article having a columnar grained or equiaxed crystallographic structure.

Having described the invention, the following is claimed:

1. A method of casting an article having a thin wall portion with a thickness of 0.060 inches or less, a width of at least four inches, and a height of at least six inches, said method comprising the steps of providing an article pattern having at least a portion with a configuration corresponding to the configuration of the thin wall portion of the article, providing a reinforcing pattern which is spaced from the portion of the article pattern having a configuration corresponding to the thin wall portion of the article, covering both the article pattern and the reinforcing pattern with a coating of wet ceramic material which encloses the article pattern and the reinforcing pattern, said step of covering the article pattern and the reinforcing pattern with a coating of wet ceramic material includes filling space between the portion of the article pattern having a configuration corresponding to the configuration of the thin wall portion of the article and the reinforcing pattern with wet ceramic material, forming a mold structure and a reinforcing structure with a connecting body of ceramic material extending between the portion of the article pattern having a configuration corresponding to the thin wall portion of the article and the reinforcing pattern by drying the coating of wet ceramic material, removing the article pattern from the mold structure to leave a mold cavity having a configuration corresponding to the configuration of the article, conducting molten metal into the mold cavity, and transmitting force from a portion of the mold structure having a configuration corresponding to the configuration of the thin wall portion of the article to the reinforcing structure through the connecting body of ceramic material to support the portion of the mold structure having a configuration corresponding to the configuration of the thin wall portion of the article with the reinforcing structure.

2. A method as set forth in claim 1 further including the step of removing the reinforcing pattern from the reinforcing structure to leave a cavity in the reinforcing structure.

3. A method as set forth in claim 1 wherein said step of providing a reinforcing pattern includes providing a reinforcing pattern having a pair of major side surfaces interconnected by minor side surfaces, said method further includes positioning the reinforcing pattern and the article pattern relative to each other with the major side surfaces on the reinforcing pattern extending transverse to a major side surface of the portion of the article pattern having a configuration corresponding to the thin wall portion of the article.

4. A method as set forth in claim 1 further including the step of positioning the reinforcing pattern and article pattern relative to each other with the space between an outer side surface of the portion of the article pattern having a configuration corresponding to the configuration of the thin wall portion of the article and the reinforcing pattern being greater than the thickness of the thin wall portion of the article.

5. A method as set forth in claim 1 wherein said step of providing an article pattern includes providing an article pattern formed of wax, said step of providing a reinforcing pattern includes providing a reinforcing pattern formed of wax, said step of removing the article pattern from the mold structure includes melting the wax article pattern, said method further includes the step of removing the reinforcing pattern from the mold structure, said step of removing the reinforcing pattern from the mold structure includes melting the wax reinforcing pattern.

6. A method as set forth in claim 1 further including the step of positioning the reinforcing pattern and article pattern relative to each other with a space of 0.2 inches to 0.5 inches between an outer side surface of the article pattern and the reinforcing pattern as measured in a direction perpendicular to a major side surface of the article pattern.

7. A method as set forth in claim 1 wherein said step of providing a reinforcing pattern includes providing a reinforcing pattern having a pair of longitudinally extending edge portions which are spaced apart by a distance between 0.5 and 2.5 inches.

8. A method of casting an article having a thin wall portion with a thickness of 0.060 inches or less, a width of at least four inches and a height of at least six inches, said method comprising the steps of providing an article pattern having at least a portion with a configuration corresponding to the configuration of the thin wall portion of the article, providing first and second reinforcing pattern sections, positioning the first and second reinforcing pattern sections adjacent to opposite sides of the article pattern, said step of positioning the first and second reinforcing pattern sections adjacent to opposite sides of the article pattern includes positioning the first reinforcing pattern section adjacent to the article pattern with a space between the first reinforcing pattern section and a first side of the article pattern and positioning the second reinforcing pattern adjacent to the article pattern with a space between the second reinforcing pattern section and a second side of the article pattern, covering the article pattern and the first and second reinforcing patterns with mold material, said step of covering the article pattern and first and second reinforcing patterns with mold material includes filling the spaces between the first and second reinforcing patterns and the article pattern with mold material, removing the article pattern from the mold material to leave a mold cavity having a configuration corresponding to the configuration of the article, and conducting molten metal into the mold cavity.

9. A method as set forth in claim 8 wherein said step of positioning the first reinforcing pattern section adjacent to the article pattern with a space between the first reinforcing pattern section and a first side of the article pattern includes positioning the first reinforcing pattern section with a space of between approximately 0.2 inches and 0.5 inches between the first reinforcing pattern section and the first side of the article pattern, said step of positioning the second reinforcing pattern section adjacent to the article pattern with a space between the second reinforcing pattern and a second side of the article pattern includes positioning the second reinforcing pattern section with a space between approximately 0.2 inches and 0.5 inches between the second reinforcing pattern section and the second side of the article pattern.

10. A method as set forth in claim 8 wherein said step of providing first and second reinforcing pattern sections includes providing first and second reinforcing pattern sections having linear longitudinal edges, said step of positioning the first and second reinforcing pattern sections adjacent to opposite sides of the article pattern includes positioning the first reinforcing pattern with the linear longitudinal edge of the first reinforcing pattern section extending parallel to the first side of the article pattern and positioning the second reinforcing pattern with the linear longitudinal edge of the second reinforcing pattern section extending parallel to the second side of the article pattern.

11. A method as set forth in claim 8 further including the step of removing the first and second reinforcing pattern sections from the mold material to leave cavities in the mold material.

* * * * *